US008708758B2

(12) United States Patent
Peng

(10) Patent No.: US 8,708,758 B2
(45) Date of Patent: Apr. 29, 2014

(54) ELECTRICAL RECEPTACLE STRUCTURE

(71) Applicant: Zentech Electronics Co., Ltd, New Taipei (TW)

(72) Inventor: Kuo-Ching Peng, New Taipei (TW)

(73) Assignee: Zentech Electronics Co., Ltd., New Taipei (TW)

( * ) Notice: Subject to any disclaimer, the term of this patent is extended or adjusted under 35 U.S.C. 154(b) by 0 days.

(21) Appl. No.: 13/749,373

(22) Filed: Jan. 24, 2013

(65) Prior Publication Data

US 2013/0225013 A1 Aug. 29, 2013

(30) Foreign Application Priority Data

Feb. 23, 2012 (CN) ..... 2012 1 0041984

(51) Int. Cl.
*H01R 4/48* (2006.01)
*H01R 13/15* (2006.01)

(52) U.S. Cl.
CPC ..... *H01R 13/15* (2013.01)
USPC ..... 439/822

(58) Field of Classification Search
USPC ..... 439/729, 818, 822; 200/251, 255, 282
See application file for complete search history.

(56) References Cited

U.S. PATENT DOCUMENTS

| | | | | | |
|---|---|---|---|---|---|
| 3,201,556 | A * | 8/1965 | Baird | 439/251 |
| 3,427,419 | A * | 2/1969 | Findley, Jr | 200/255 |
| 3,566,335 | A * | 2/1971 | Powell | 439/251 |
| 4,486,636 | A * | 12/1984 | Prietzel et al. | 200/255 |
| 5,098,318 | A * | 3/1992 | Suter | 439/819 |
| 7,581,972 | B2 * | 9/2009 | Daamen | 439/249 |

FOREIGN PATENT DOCUMENTS

CN 1812209 A 8/2006

* cited by examiner

*Primary Examiner* — Neil Abrams
*Assistant Examiner* — Travis Chambers
(74) *Attorney, Agent, or Firm* — Muncy, Geissler, Olds & Lowe, P.C.

(57) ABSTRACT

An electrical plug receptacle includes a base seat, a first conductive strip, and a second conductive strip, wherein the first conductive strip and the second conductive strip respectively have a bottom part and a top part, the bottom parts of the first conductive strip and the second conductive strip are connected to the base seat, a slot is formed between the top parts of the first conductive strip and the second conductive strip, and the top parts of the first conductive strip and the second conductive strip are connected by an elastic element.

8 Claims, 5 Drawing Sheets

ELECTRICAL RECEPTACLE STRUCTURE

CROSS-REFERENCE TO RELATED APPLICATION

This application claims the benefit of China Patent Application No. 201210041984.9, filed on Feb. 23, 2012, which is hereby incorporated by reference for all purposes as if fully set forth herein.

FIELD OF THE INVENTION

The present invention relates to an electrical socket, and more particularly to an electrical receptacle structure.

BACKGROUND

In China patent No. CN1812209A, it discloses an electrical socket security circuit device, In the device, an electrical socket is composed of two receptacles, each of the receptacles has a U-shaped structure, and the two sides of the top edge of the receptacle respectively have a spring sheet. When an electrical plug blade is inserted into the two spring sheets, the spring sheets hold the electrical plug blade and make conductivity with the electrical plug blade. In addition, the two sides of the receptacles are equipped with a fixing member and a movable conductive member. The movable conductive member and the fixing member can be electrically connected by inserting the electrical plug therebetween or pushing the movable conductive member and the fixing member. In an actual use process, the socket security circuit device has the drawback as follow: the fixing member and the movable conductive member are gradually remaining deformed and can't not recovered after a, period of use, so that the fixing member and the movable conductive member can't recover from a deformation to an original shape. If a deformation of the fixing member and the movable conductive member is too over, the receptacle may keep carry charges, and the electrical socket use safety will be greatly reduced, so that electrical shocks due to improper use can be effectively avoided.

SUMMARY

In order to solve the problems of conventional art, an objective of the present invention is to provide a receptacle structure for an electrical plug to improve the safety of using socket and effectively avoid electrical shocks due to improper use.

To achieve the objective, the present invention provides a receptacle structure for an electrical plug including a base seat, a first conductive strip, and a second conductive strip, wherein the first conductive strip and the second conductive strip respectively have a bottom part and a top part, the bottom parts of the first conductive strip and the second conductive strip are connected to the base seat, a slot is formed by the top parts of the first conductive strip and the second conductive strip, and the top parts of the first conductive strip and the second conductive strip are connected by an elastic element. The slot formed by the first conductive strip and the second conductive strip is enlarged outwardly when an electrical plug is inserted into the slot, and the slot formed by the first conductive strip and the second conductive strip is enclosed inwardly when the electrical plug is removed. Enlarging and enclosing of the slot is caused not by the deformation of the first conductive strip and the second conductive strip themselves, but by the elastic element connecting with the first conductive strip and the second conductive strip; accordingly, the first conductive strip and the second conductive strip can still recover from a deformation to their original shape after a period of use, and a problem of continuous charging caused by an over deformation of the first conductive strip and the second conductive strip of the receptacle structure wouldn't be occurred. Thereby, the safety of using sockets can be increased and electrical shocks due to improper use can be effectively avoided.

In one embodiment of the present invention, a lateral side of the top part of the first conductive strip face to the second conductive strip has a first guide surface, a lateral side of the top part of the second conductive strip face to the first conductive strip has a second guide surface, and the first guide surface and the second guide surface constitute a V shape. The first guide surface and the second guide surface can guide the electrical plug such that the electrical plug can be smoothly inserted into the receptacle structure.

In one embodiment of the present invention, a lateral side of the top part of the first conductive strip away from the second conductive strip and a lateral side of the top part of the second conductive strip away from the first conductive strip have a contact bump, respectively, such that the first conductive strip and the second conductive strip may contact smoothly with adjacent parts.

In one embodiment of the present invention, a hole is formed in the base seat, the bottom parts of the first conductive strip and the second conductive strip have a C-shaped block, and the C-shaped block is engaged with the hole. To engage the C-shaped block with the hole of the base seat has advantage in that the structure is simple and easily manufactured, and the cost can be reduced.

In one embodiment of the present invention, the elastic element is a spring having rings at two ends thereof, and the top parts of the first conductive strip and the second conductive strip have a hook respectively, such that it is very convenient to engage the ring with the hook during the installing process.

In one embodiment of the present invention, the base seat includes a base plate, a left position limiting plate, and a right position limiting plate, and the first conductive strip and the second conductive strip are correspondingly disposed in a front side and a rear side of the base plate, the left position limiting plate and the right position limiting plate are respectively disposed in a right side and a left side of the base plate, and the slot is located among the left position limiting plate , the right position limiting plate, the first conductive strip, and the second conductive strip, such that the left position limiting plate and the right position limiting plate can prevent the electrical plug from shifting right or left, and keep the electrical plug in the slot.

In one embodiment of the present invention, one of the left position limiting plate and the right position limiting is disposed of a position limiting arm, and the position limiting arm is disposed at a lateral surface of the left position limiting plate or the right position limiting plate away from the slot.

In one embodiment of the present invention, the base plate, the left position limiting plate, and the right position limiting plate are integrally formed, and the left position limiting plate or the right position limiting plate are integrally formed with the position limiting arm.

In one embodiment of the present invention, a front edge and a rear edge of the lateral surface of the left position limiting plate or the right position limiting plate away from the slot has the position limiting arm, such that the receptacle structure can conveniently equipped with a socket.

The present invention has an advantageous effect in that the safety of using sockets can be increased and electrical shocks due to improper use can be effectively avoided.

DETAILED DESCRIPTION

In order to make above purposes, features, and characteristics more apparent, the embodiments related to the present invention are illustrated as follows in detail in conjunction with the drawings.

Figure 1:
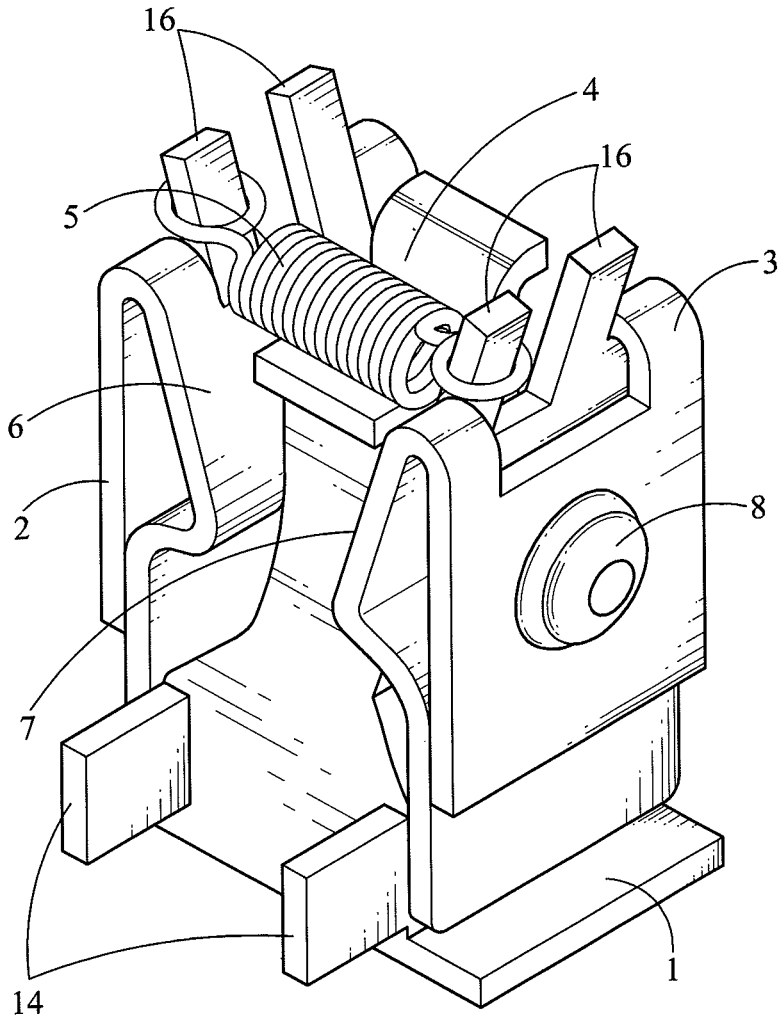
FIG. 1 is a structural view illustrating a receptacle structure according to the present invention.
Figure 2:
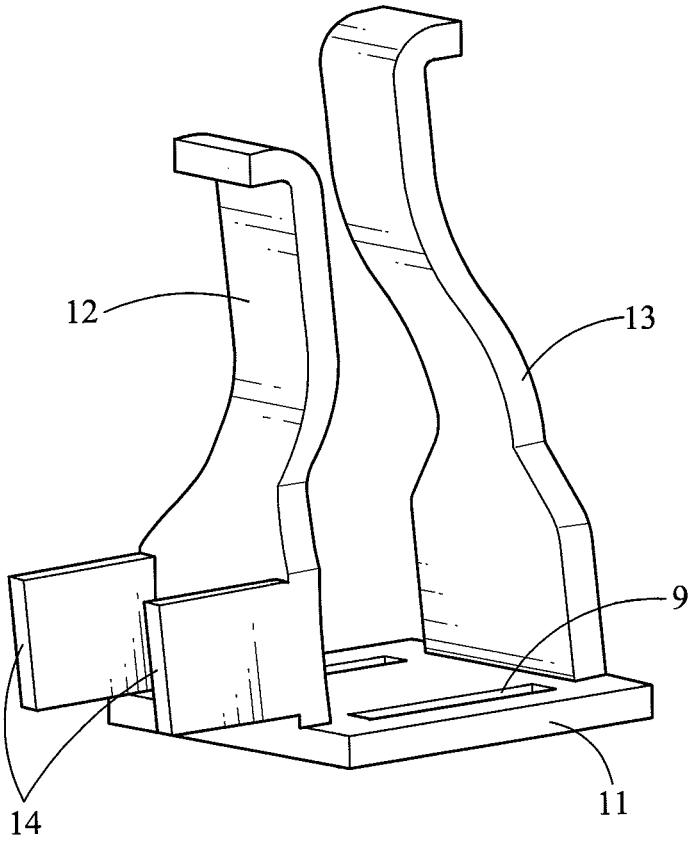
FIG. 2 is a structural view illustrating a base seat of the receptacle structure according to present invention.
Figure 5:
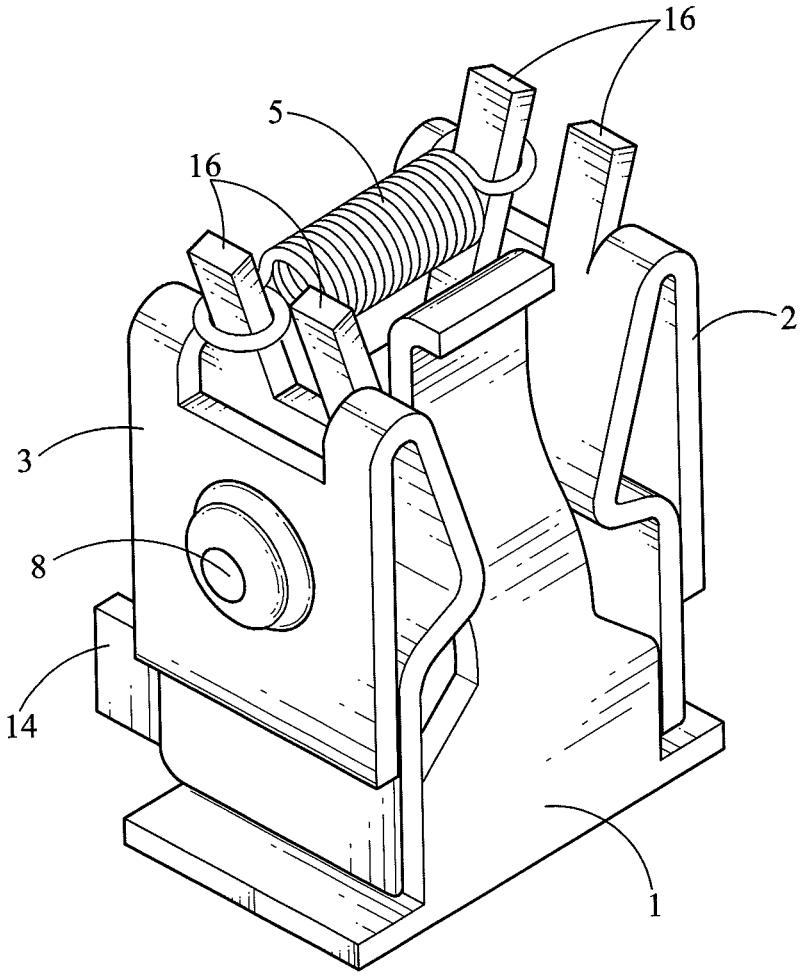
FIG. 5 is structural view illustrating the receptacle structure of FIG. 1 in another direction according to the present invention.
Figure 6:
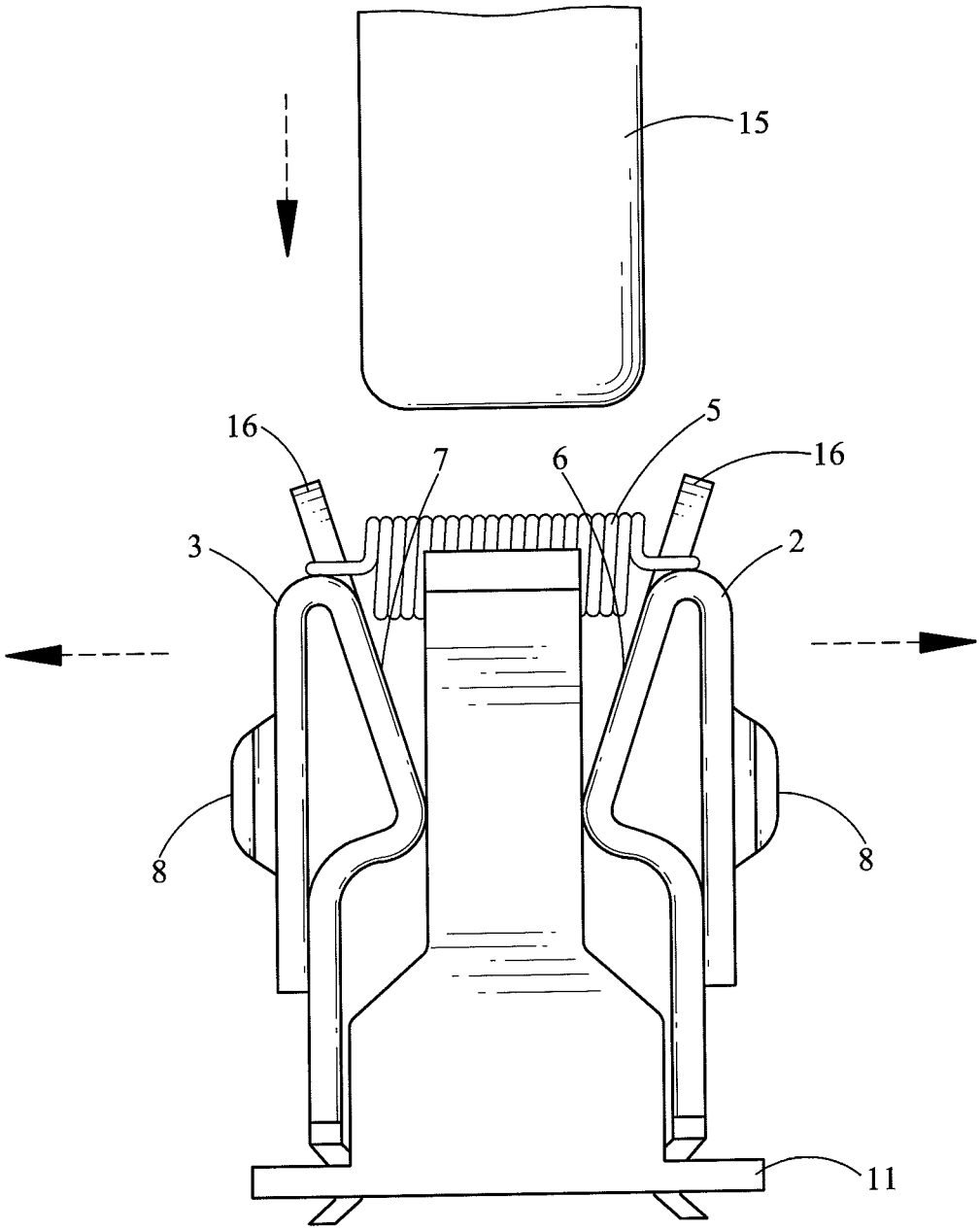
FIG. 6 is structural view illustrating the receptacle structure of FIG. 1 in another direction according to the present invention.

As shown in FIG. 1, FIG. 5, and FIG. 6, a receptacle structure according to the present invention includes a base seat 1, a first conductive strip 2, and a second conductive strip 3, wherein the first conductive strip 2 and the second conductive strip 3 respectively have a bottom part and a top part. The bottom parts of the first conductive strip 2 and the second conductive strip 3 are connected to the base seat 1, and a slot 4 is formed between the top parts of the first conductive strip 2 and the second conductive strip 3. In addition, the top parts of the first conductive strip 2 and the second conductive strip 3 are connected by an elastic element 5. The elastic element 5 is a spring having rings at two ends thereof, and the top parts of the first conductive strip 2 and the second conductive strip 3 have a hook 16, respectively.

As shown in FIG. 1, FIG. 2, FIG. 3, and FIG. 4, they illustrate the base seat 1 including: a base plate 11, a left position limiting plate 12 and a right position limiting plate 13. A hole 9 is formed in the base seat 1, the bottom parts of the first conductive strip 2 and the second conductive strip 3 have a C-shaped block 10, and the C-shaped block 10 is engaged with the hole 9; therefore, the first conductive strip 2 and the second conductive strip 3 are correspondingly disposed in a front side and a rear side of the base plate 11, and the left position limiting plate 12 and the right position limiting plate 13 are respectively disposed in a right side and a left side of the base plate 11. In addition, the slot 4 is located among the left position limiting plate 12, the right position limiting plate 13, the first conductive strip 2, and the second conductive strip 3.

Figure 3:
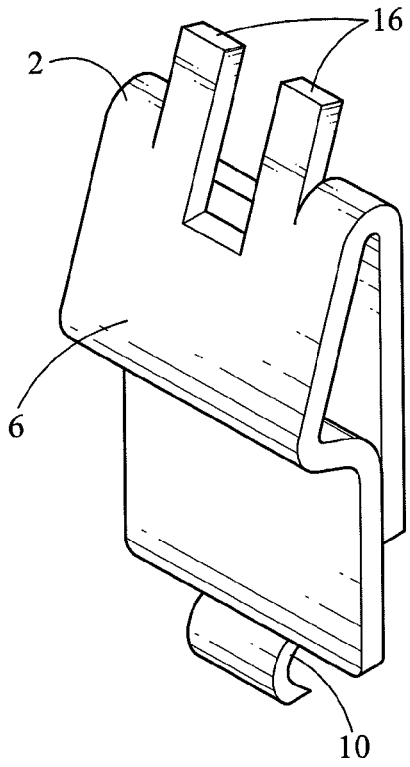
FIG. 3 is structural view illustrating a first conductive strip of the receptacle structure according to the present invention.
Figure 4:
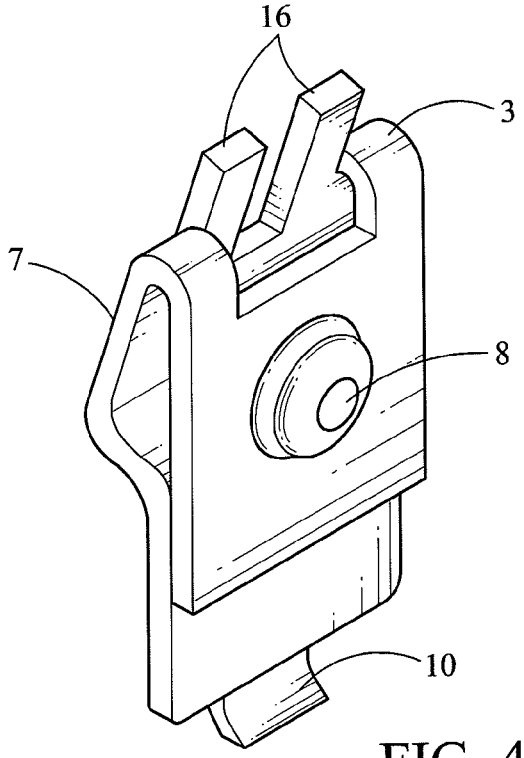
FIG. 4 is structural view illustrating a second conductive strip of the receptacle structure according to the present invention.

As shown in FIG. 1, FIG. 3, and FIG. 4, they illustrates that a lateral side of the top part of the first conductive strip 2 face to the second conductive strip 3 has a first guide surface 6, a lateral side of the top part of the second conductive strip 7 face to the first conductive strip 2 has a second guide surface 7, and the first guide surface 6 and the second guide surface 7 constitute a V shape. In addition, a lateral side of the top part of the first conductive strip 2 away from the second conductive strip 3 and a lateral side of the top part of the second conductive strip 3 away from the first conductive strip 2 have a contact bump 8, respectively. One of the left position limiting plate 12 and the right position limiting plate 13 is disposed of two position limiting arms 14, and the two position limiting arm 14 are disposed at a lateral surface of the left position limiting plate 12 or the right position limiting plate 13 away from the slot 4. Furthermore, a front edge and a rear edge of the lateral surface of the left position limiting plate 12 or the right position limiting plate 13 away from the slot 4 have the position limiting arm 14. The base plate 11, the left position limiting plate 12, and the right position limiting plate 13 are integrally formed, and the left position limiting plate 12 or the right position limiting plate 13 are integrally formed with the position limiting arm 14.

As shown in FIG. 6, it illustrates a use condition of the receptacle of the embodiment, when an electrical plug 15 is inserted into the receptacle by a user, the first conductive strip 2 and the second conductive strip 3 which are pushed by the electrical plug 15 move forwards and backwards, respectively, such that the first conductive strip 2 and the second conductive strip 3 are separately rotated forwards and backwards by using their bottom part as an axis, and the first conductive strip 2 and the second 3 are contacted with the adjacent part through the contact bump 8. When the electrical plug 15 is removed, the first conductive strip 2 can recover from a deformation to their original shape due to the function of the elastic element 5. Accordingly, the slot 4 formed by the first conductive strip 2 and the second conductive strip 3 is enlarged outwardly when an electrical plug 15 is inserted into the slot 4, and the slot 4 formed by the first conductive strip 2 and the second conductive strip 3 is enclosed inwardly when the electrical plug 15 is removed. Enlarging and enclosing of the slot 4 is caused not by the deformation of the first conductive strip 2 and the second conductive strip 3 themselves, but by the elastic element 5 connecting with the first conductive strip and the second conductive strip; accordingly, the first conductive strip 2 and the second conductive strip 3 can still recover from a deformation to their original shape after a period of use, and a problem of continuous charging caused by an over deformation of the first conductive strip 2 and the second conductive strip 3 of the receptacle structure wouldn't be occurred. Thereby, the safety of using sockets can be increased and electrical shocks due to improper use can be effectively avoided. The first guide surface 6 and the second guide surface 7 can lead the electrical plug 15 to insert smoothly.

The embodiments of the present invention described above and shown in the drawings should not be construed as limiting the technical spirit of the present invention. The scope of the present invention is restricted by only the claims, and a person having ordinary skill in the art to which the present invention pertains may improve and modify the technical spirit of the present invention in various forms. Accordingly, the modifications and modifications will fall within the scope of the present invention as long as they are evident to those skilled in the art.

What is claimed is:

1. An electrical plug receptacle including:

a base seat;

a first conductive strip; and a second conductive strip, wherein the first conductive strip and the second conductive strip respectively have a bottom part and a top part, the bottom parts of the first conductive strip and the second conductive strip are connected to the base seat, a slot is formed between the top parts of the first conductive strip and the second conductive strip, and the top parts of the first conductive strip and the second conductive strip are connected by an elastic element, wherein a hole is formed in the base seat, the bottom parts of the first conductive strip and the second conductive strip have a C-shaped block, and the C-shaped block is engaged with the hole.

2. The electrical plug receptacle of claim 1, wherein a lateral side of the top part of the first conductive strip face to the second conductive strip has a first guide surface, a lateral side of the top part of the second conductive strip face to the first conductive strip has a second guide surface, and the first guide surface and the second guide surface constitute a V shape.

3. The electrical plug receptacle of claim 1, wherein the elastic element is a spring having rings at two ends thereof, and the top parts of the first conductive strip and the second conductive strip have a hook, respectively.

4. The electrical plug receptacle of claim 1, wherein the base seat includes a base plate, a left position limiting plate, and a right position limiting plate, and the first conductive strip and the second conductive strip are correspondingly disposed in a front side and a rear side of the base plate, the left position limiting plate and the right position limiting plate are respectively disposed in a right side and a left side of the base plate, and the slot is located among the left position limiting plate, the right position limiting plate, the first conductive strip, and the second conductive strip.

5. The electrical plug receptacle of claim 4, wherein one of the left position limiting plate and the right position limiting is disposed of two position limiting arms, and the two position limiting arms are disposed at a lateral surface of the left position limiting plate or the right position limiting plate away from the slot.

6. The electrical plug receptacle of claim 5, wherein the base plate, the left position limiting plate, and the right position limiting plate are integrally formed, and the left position limiting plate or the right position limiting plate are integrally formed with the position limiting arm.

7. The electrical plug receptacle of claim 5, wherein a front edge and a rear edge of the lateral surface of the left position limiting plate or the right position limiting plate away from the slot have the position limiting arm.

8. An electrical plug receptacle including:

a base seat;

a first conductive strip; and a second conductive strip, wherein the first conductive strip and the second conductive strip respectively have a bottom part and a top part, the bottom parts of the first conductive strip and the second conductive strip are connected to the base seat, a slot is formed between the top parts of the first conductive strip and the second conductive strip, and the top parts of the first conductive strip and the second conductive strip are connected by an elastic element, wherein a lateral side of the top part of the first conductive strip away from the second conductive strip and a lateral side of the top part of the second conductive strip away from the first conductive strip have a contact bump, respectively, wherein a hole is formed in the base seat, the bottom parts of the first conductive strip and the second conductive strip have a C-shaped block, and the C-shaped block is engaged with the hole.

* * * * *